US009914164B1

(12) United States Patent
Siekirk, III et al.

(10) Patent No.: US 9,914,164 B1
(45) Date of Patent: Mar. 13, 2018

(54) MACHINE PRESS

(71) Applicants: John F Siekirk, III, Clarkston, MI (US); Dajun Zhou, Troy, MI (US); Changqing Du, Troy, MI (US); Robert D Miller, Lake Orion, MI (US)

(72) Inventors: John F Siekirk, III, Clarkston, MI (US); Dajun Zhou, Troy, MI (US); Changqing Du, Troy, MI (US); Robert D Miller, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 15/265,951

(22) Filed: Sep. 15, 2016

(51) Int. Cl.
*B21D 22/06* (2006.01)
*B21D 24/08* (2006.01)

(52) U.S. Cl.
CPC ..... *B21D 24/08* (2013.01); *B21D 22/06* (2013.01)

(58) Field of Classification Search
CPC ..... B21D 22/06; B21D 22/10; B21D 22/22; B21D 24/04; B21D 24/16
See application file for complete search history.

(56) References Cited

U.S. PATENT DOCUMENTS

| | | | | |
|---|---|---|---|---|
| 3,494,169 | A * | 2/1970 | Saunders | B21D 22/22 72/350 |
| 4,373,371 | A | 2/1983 | Liu | |
| 8,296,922 | B2 | 10/2012 | Flehmig et al. | |
| 2013/0319068 | A1 * | 12/2013 | Zhou | B21D 22/22 72/356 |

OTHER PUBLICATIONS

R.A. Ayres, SHAPESET: A Process to Reduce Sidewall Curl Springback in High-Strength Steel Rails, J. Applied Metalworking, 1984 American Society for Metals, vol. 3, No. 2, Jan. 1984, pp. 127-134.

High Strength Steel Stamping Design Manual, Auto/Steel Partnership, 2000, 67 Pages.

* cited by examiner

*Primary Examiner* — Debra Sullivan
(74) *Attorney, Agent, or Firm* — Ralph E Smith

(57) ABSTRACT

A binder assembly for stamping sheet material includes an upper die, a stationary punch, an outer ring, and an inner ring. The stationary punch is aligned to be received inside a cavity of the upper die. The outer ring and the inner ring extend around the punch and are movable relative thereto. The inner ring includes teeth on a top surface and is positioned an initial distance from an end of the punch. The upper die is driven along the punch the initial distance such that the punch is received inside the cavity of the upper die a partial distance and a remaining distance such that the punch is received inside the cavity of the upper die a deeper distance.

12 Claims, 3 Drawing Sheets

MACHINE PRESS

FIELD

The present disclosure relates to a machine press.

BACKGROUND

This section provides background information related to the present disclosure and is not necessarily prior art.

Traditionally, machines used stamping techniques to stamp sheet material that led to spring back in the sheet material. Spring back is the geometric change made to the sheet material at the end of the forming process when the sheet material has been released from the machine. Upon completion of the stamping operation, the sheet material springs back thereby affecting the accuracy of the finished sheet material. Modern machines and stamping techniques (e.g., stake beading) reduce spring back at the expense of wasting sheet material.

The proposed machine and stamping technique eliminates spring back in the stamped sheet material while avoiding waste material.

SUMMARY

This section provides a general summary of the disclosure, and is not a comprehensive disclosure of its full scope or all of its features.

In one form, the present disclosure provides a binder assembly for stamping a sheet material. The binder assembly includes an upper die, a punch, and outer and inner rings. The upper die has a cavity that receives the punch aligned thereto. The outer ring and the inner ring extend around the punch and are movable relative thereto. The inner ring has teeth on a top surface and is positioned axially an initial distance from the end of the punch. The upper die is driven along the punch the initial distance such that the punch is received inside the cavity of the upper die a partial distance and the outer ring moves relative to the punch the initial distance until the outer ring is positioned radially adjacent to the inner ring. The upper die is further driven a remaining distance such that the punch is received inside the cavity of the upper die a deeper distance and the outer ring and the inner ring move simultaneously relative to the punch the remaining distance.

In some configurations, the upper die includes teeth on a contact surface.

In some configurations, the teeth on the contact surface of the upper die are opposite the teeth on the top surface of the inner ring.

In some configurations, inner and outer edges of the upper die inner walls and edges of the punch outer walls include radii.

In some configurations, the inner walls of the upper die are adjacent to the outer walls of the punch when the upper die is driven downwardly along the punch the initial distance and the punch is received inside the cavity of the upper die the partial distance.

In some configurations, a force of the upper die overcomes a force provided to the outer ring causing the outer ring to move relative to the punch the initial distance.

In some configurations, the teeth of the inner ring cooperate with a contact surface of the upper die to grip the sheet material outside the cavity and restrict the lateral movement thereof once the upper die is driven the initial distance along the punch.

In some configurations, a force of the upper die overcomes the force provided to the outer ring and a force provided to the inner ring causing the outer ring and the inner ring to move relative to the punch the remaining distance.

In another form, the present disclosure provides a method for stamping sheet material using a binder assembly. The method includes positioning an inner ring radially between a punch and an outer ring and axially at an initial distance from an end of the punch; positioning the sheet material on the punch and the outer ring so that the sheet material extends laterally between a upper die and the punch and the outer ring; driving the upper die along the punch the initial distance such that the sheet material moves laterally toward the cavity to facilitate shaping of the sheet material; gripping the sheet material outside the cavity with the inner ring and the upper die once the upper die is driven the initial distance to restrict the lateral movement of the sheet material outside the cavity; and driving the upper die along the punch a remaining distance such that the sheet material inside the cavity vertically stretches to complete shaping of the sheet material.

In some configurations, the method includes positioning the outer ring relative to the punch so that the outer ring and the top surface of the punch are co-planar prior to the sheet material placement on the punch and the outer ring.

In some configurations, the method includes driving the outer ring downwardly along with the upper die the initial distance until the outer ring is positioned radially adjacent to the inner ring.

In some configurations, teeth on a top surface of the inner ring cooperate with the upper die to grip the sheet material outside the cavity and restrict lateral movement of the sheet material once the upper die is driven along the punch the initial distance.

In some configurations, the method includes stretching the sheet material between inner walls of the upper die and outer walls of the punch vertically when the upper die is driven along the punch the remaining distance.

In some configurations, the method includes driving the outer ring and the inner ring downwardly relative to the punch when the upper die is driven along the punch the remaining distance.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

Corresponding reference numerals indicate corresponding parts throughout the several views of the drawings.

DETAILED DESCRIPTION

Example embodiments will now be described more fully with reference to the accompanying drawings.

Figure 2:
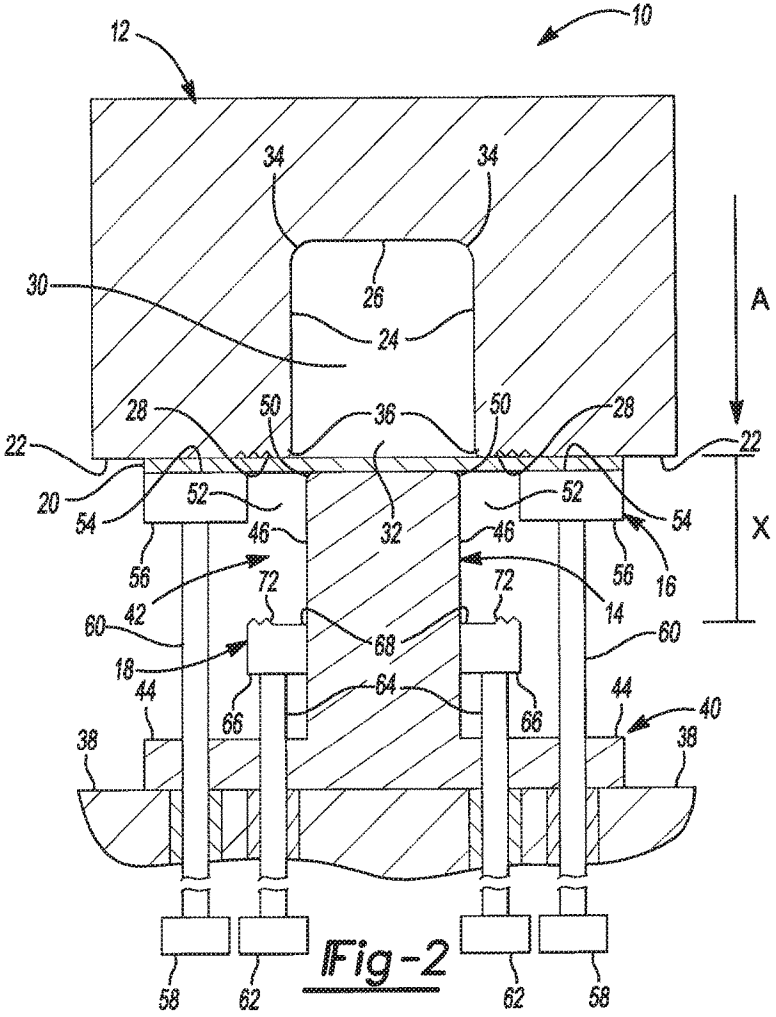
FIG. 2 is a cross-sectional view of the sheet material positioned between an upper die and a punch and outer ring of the binder assembly of FIG. 1.

With reference to FIGS. 1-4, a binder assembly 10 is provided that includes an upper die 12, a punch 14, and outer and inner rings 16, 18 extending around the punch 14 and movable relative thereto. A sheet material 20 (e.g., sheet metal) is positioned on the punch 14 and the outer ring 16, extending laterally between the upper die 12 and the punch 14 and the outer ring 16 (FIG. 2). The upper die 12 is driven downwardly (i.e., direction A) along the punch 14 an initial distance X (FIG. 3) in which the outer ring 16 moves relative to the punch 14 and a remaining distance Y (FIG. 4) in which the outer ring 16 and the inner ring 18 move relative to the punch 14. As will be described in more detail below, the inner ring 18 cooperates with the upper die 12 to grip the sheet material 20 when the upper die 12 is driven downwardly along the punch 14 the remaining distance Y to restrict or limit the lateral movement of the sheet material 20 (i.e., in directions perpendicular to direction A) relative to the punch 14 while allowing axial stretching (i.e., in a direction parallel to direction A) of a portion of the sheet material 20.

As shown in FIGS. 1-4, the upper die 12 is generally U-shaped and made out of a metallic material. The upper die 12 includes a sheet material contact surface 22, inside walls 24, and an upper cavity surface 26. In some configurations, the sheet material contact surface 22 includes upper teeth 28 on a portion thereof. The sheet material contact surface 22 extends parallel to the upper cavity surface 26. The inside walls 24 cooperate with the upper cavity surface 26 to form a cavity 30 having an opening 32. The inside walls 24 extend parallel to each other and perpendicular to the upper cavity surface 26 and the sheet material contact surface 22. The inside walls 24 include inner and outer radii 34, 36 that attach to the upper cavity surface 26 and the sheet material contact surface 22, respectively. The upper cavity surface 26 faces the sheet material 20 positioned on the punch 14 and the outer ring 16.

As shown in FIGS. 1-4, the punch 14 is stationary on a support surface 38 and made out of a metallic material. The punch 14 is received inside the cavity 30 of the upper die 12 an initial distance when the upper die 12 is driven downwardly along the punch 14 the initial distance X and is received therein a deeper distance when the upper die 12 is driven downwardly along the punch 14 the remaining distance Y. The punch 14 includes a lower end 40 and an upper end 42. The lower end 40 is positioned on the support surface 38 beneath the upper end 42. The lower end 40 includes a contact surface 44 that extends parallel to the sheet material contact surface 22.

The upper end 42 of the punch 14 is aligned with the cavity 30 of the upper die 12 and is shaped to be received within the cavity 30. The upper end 42 includes outer walls 46 and an engagement surface 48. The outer walls 46 extend parallel to the inside walls 24 of the upper die 12 and extend perpendicular to the engagement surface 48 and the contact surface 44. The outer walls 46 are adjacent to the inside walls 24 of the upper die 12 when the upper end 42 is received within the cavity 30. The outer walls 46 include punch radii 50 that attach to the engagement surface 48. The engagement surface 48 extends parallel to the contact surface 44. The engagement surface 48 is disposed inside the cavity 30 of the upper die 12 when the upper end 42 is received within the cavity 30.

Figure 1:
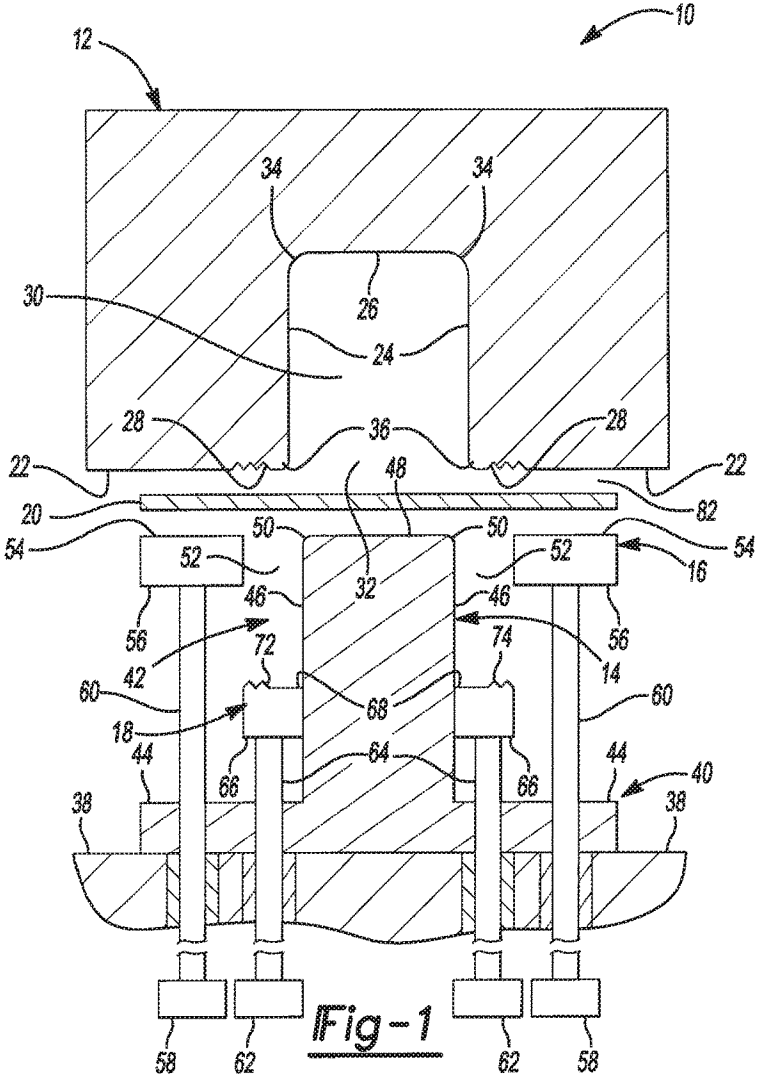
FIG. 1 is a cross-sectional view of a sheet material positioned on a binder assembly according to the principles of the present disclose.
Figure 4:
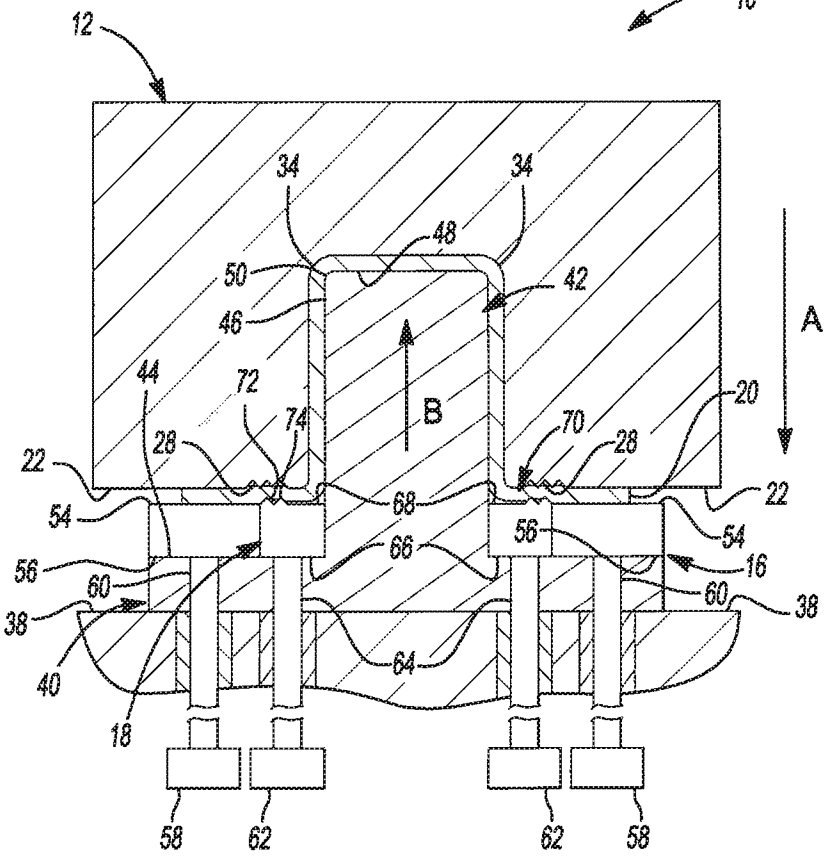
FIG. 4 is a cross-sectional view of the upper die driving downward along the punch a remaining distance.
Figure 3:
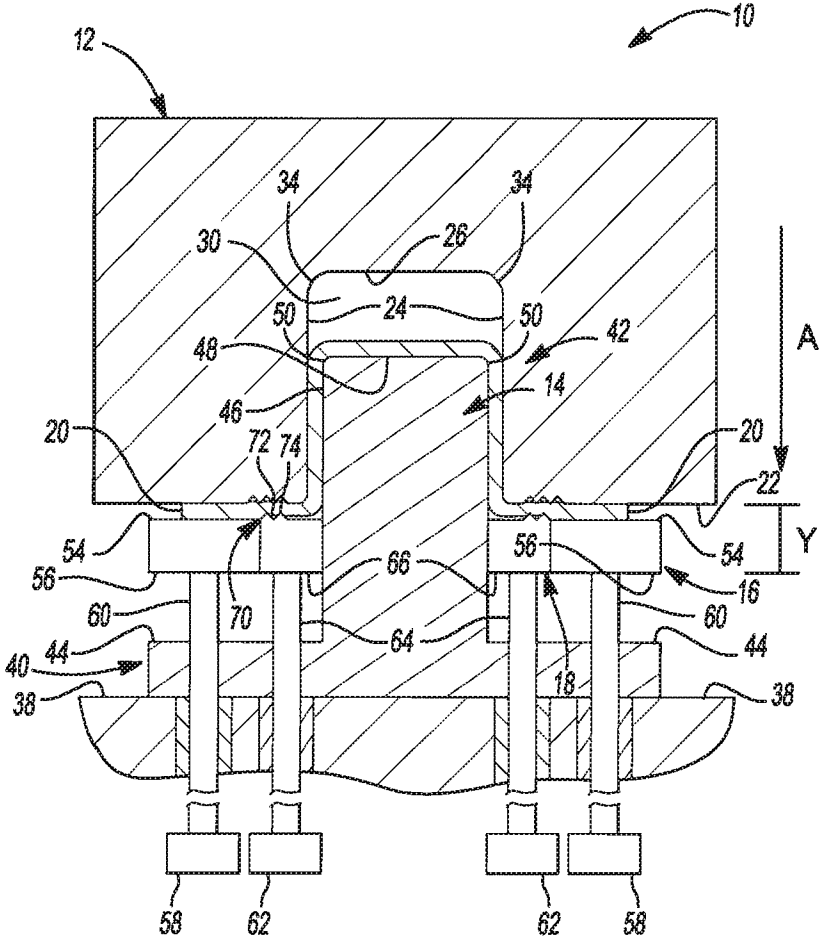
FIG. 3 is a cross-sectional view of the upper die driving downward along the punch an initial distance.

As shown in FIGS. 1-4, the outer ring 16 extends 360 degrees around the punch 14 and is movable relative thereto. The outer ring 16 is separated from the outer walls 46 of the upper end 42 of the punch 14 by gaps 52. The outer ring 16 is formed from a metallic material and includes an upper surface 54 and a bottom surface 56. The upper surface 54 and the bottom surface 56 extend parallel to each other and face in opposite directions. The upper and lower surfaces 54, 56 extend parallel to the sheet material contact surface 22 of the upper die 12 and perpendicular to the outer walls 46 of the upper end 42 of the punch 14. As shown in FIGS. 3 and 4, the upper surface 54 of the outer ring 16 remains in contact with the sheet material 20 when the upper die 12 is driven along the punch 14 the initial distance X and the remaining distance Y. As shown in FIGS. 1 and 2, the outer ring 16 is positioned around the punch 14 such that the upper surface 54 and the engagement surface 48 of the upper end 42 of the punch 14 are co-planar when the outer ring 16 is in a rest position.

The bottom surface 56 extends parallel to the sheet material contact surface 22 of the upper die 12 and perpendicular to the outer walls 46 of the upper end 42 of the punch 14. As shown in FIG. 4, the bottom surface 56 of the outer ring 16 contacts the contact surface 44 of the lower end 40 of the punch 14 once the upper die 12 has been driven the initial distance X and the remaining distance Y along the punch 14. Nitrogen cylinders 58, for example, provide a force to the outer ring 16 via a piston assembly 60 attached to the bottom surface 56 of the outer ring 16 to maintain the outer ring 16 in the rest position (i.e., the upper surface 54 co-planar to the engagement surface 48 of the upper end 42 of the punch 14) until the outer ring 16 is forced downward by the upper die 12 as the upper die 12 moves toward the contact surface 44.

As shown in FIGS. 1-4, the inner ring 18 extends 360 degrees around the punch 14 and is movable relative thereto. The inner ring 18 is formed from a metallic material. The inner ring 18 is positioned radially between the punch 14 and the outer ring 16 and is initially positioned axially at the initial distance X from the top surface of the sheet material 20 (i.e., below the engagement surface 48 of the punch 14 and the outer ring 16). As shown in FIG. 3, the inner ring 18 is also received in the gaps 52 between the punch 14 and the outer ring 16 once the upper die 12 has been driven downwardly along the punch 14 the initial distance X. The inner ring 18 includes a lower surface 66 and a top surface 68 having teeth 70 thereon. The lower and top surfaces 66, 68 extend parallel to each other and face in opposite directions. The lower surface 66 extends parallel to the sheet material contact surface 22 of the upper die 12 and perpendicular to the outer walls 46 of the upper end 42 of the punch 14. The lower surface 66 of the inner ring 18 contacts the contact surface 44 of the lower end 40 of the punch 14 once the upper die 12 has been driven the initial distance X and the remaining distance Y along the punch 14. Hydraulic springs 62, for example, provide a force to the inner ring 18 via a piston assembly 64 attached to the lower surface 66 to maintain the inner ring in the rest position (i.e., the initial distance X from the sheet material 20) until the inner ring 18 is forced downward by the upper die 12 as the upper die 12 moves the remaining distance Y toward the contact surface 44. The top surface 68 extends parallel to the sheet material contact surface 22 of the upper die 12 and perpendicular to the outer walls 46 of the upper end 42 of the punch 14.

As shown in FIGS. 3 and 4, the teeth 70 on the top surface 68 of the inner ring 18 are directly opposite the upper teeth 28 on the sheet material contact surface 22 of the upper die 12 and contact the sheet material 20 once the upper die 12 has been driven the initial distance X. The teeth 70 on the top surface 68 of the inner ring 18 cooperate with the sheet material contact surface 22 of the upper die 12 to grip the sheet material 20 when the upper die 12 is driven along the punch 14 the remaining distance Y (FIG. 4). Each tooth 70 on the top surface 68 of the inner ring 18 includes sloped surfaces 72. The sloped surfaces 72 extend from a proximal end attached to the top surface 68 of the inner ring 18 to a distal end. Pointed ends 74 of the teeth 70 collectively cooperate with the sheet material contact surface 22 of the upper die 12 to grip the sheet material 20 while the upper die 12 is driven along the punch 14 the remaining distance Y. The upper teeth 28 of the upper die 12 are formed the same or similarly to the teeth 70 of the inner ring 18.

With continued reference to FIGS. 1-5, operation of the binder assembly 10 will be described in detail. Referring to FIG. 1, the binder assembly 10 is in a set stage where the sheet material 20 is placed in an opening 82 formed by the upper die 12, the punch 14, and the outer ring 16. As shown in FIG. 2, the binder assembly 10 is in a pre-work stage where the sheet material 20 is positioned on the punch 14 and the outer ring 16 such that the sheet material 20 extends laterally between the upper die 12 and the punch 14 and the outer ring 16. When in the pre-work stage, the upper die 12 contacts the sheet material 20, thereby closing the opening 82 shown in FIG. 1.

As shown in FIG. 3, the binder assembly 10 is in an initial-work stage (i.e., the upper die 12 is driven downwardly along the punch 14 the initial distance X) such that the upper end 42 of the punch 14 is received inside the cavity 30 of the upper die 12 the partial distance. The upper die 12 driving force overcomes the force provided to the outer ring 16 via the nitrogen cylinders 58 causing the outer ring 16 to move downwardly relative to the punch 14 the initial distance X along with the upper die 12 until positioned radially adjacent to the inner ring 18 (i.e., the inner ring 18 is received in the gaps 52 between the punch 14 and the outer ring 16). While in the initial-work stage, the sheet material 20 forms the shape of the cavity 30. The sheet material 20 outside the cavity 30 (i.e., between the sheet material contact surface 22 and the outer ring 16) is movable laterally toward the cavity 30 to facilitate shaping of the sheet material 20.

Prior to the binder assembly 10 beginning the final-work stage (i.e., the upper die 12 is driven downwardly along the punch 14 the remaining distance Y), the teeth 70 on the top surface 68 of the inner ring cooperate with the sheet material contact surface 22 of the upper die 12 to grip the sheet material 20 outside of the cavity 30. Gripping the sheet material 20 outside the cavity with the teeth 70 on the inner ring 18 restricts the sheet material 20 from moving laterally during the final-work stage and avoids waste material when the sheet material 20 completes the final-work stage.

Figure 5:
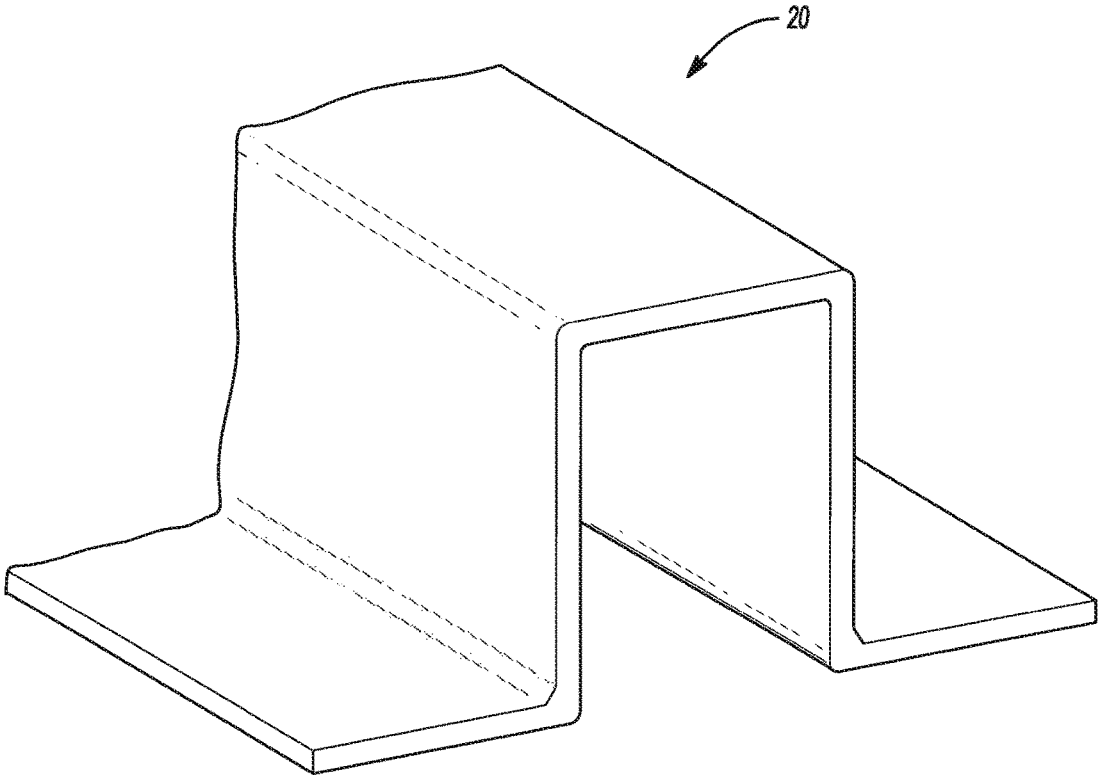
FIG. 5 is a perspective view of the sheet material after the binder assembly has completed the stamping operation.

During the final work stage (shown in FIG. 4), the upper die 12 driving force overcomes the force provided to the outer ring 16 and the inner ring 18 via the nitrogen cylinders 58 and the hydraulic springs 62, respectively, causing the outer and inner rings 16, 18 to move downwardly relative to the punch 14 the remaining distance Y. The upper end 42 of the punch 14 is received inside the cavity 30 of the upper die 12 the deeper distance. Restricting the lateral movement of the sheet material 20 outside the cavity 30 causes the sheet material 20 inside the cavity 30 (i.e., between the inside walls 24 of the upper die 12 and the outer walls 46 of the punch 14) to vertically stretch in direction B from the partial distance to the deeper distance. As shown in FIG. 5, the vertical stretching (i.e., post-stretching action) of the sheet material 20 inside of the cavity 30 eliminates spring back in the sheet material 20 once the sheet material 20 is released from the binder assembly 10.

In some embodiments, the binder assembly 10 begins the final-work stage at 80% completion of the stamping operation. In some embodiments, the binder assembly 10 begins the final-work stage at 85% completion of the stamping operation. In some embodiments, the binder assembly 10 begins the final-work stage at 90% completion of the stamping operation.

What is claimed is:

1. A binder assembly for stamping sheet material comprising:

an upper die defining a cavity;

a stationary punch positioned to be received in the cavity of the upper die; and an outer ring and an inner ring extending around the punch and movable relative thereto, the inner ring having teeth on a top surface and positioned axially an initial distance from an end of the punch, wherein the upper die is driven along the punch the initial distance such that the punch is received inside the cavity of the upper die a partial distance and the outer ring moves relative to the punch the initial distance until positioned radially adjacent to the inner ring, wherein the upper die is driven along the punch a remaining distance such that the punch is received inside the cavity of the upper die a deeper distance and the outer ring and the inner ring move simultaneously relative to the punch the remaining distance, and wherein, once the upper die is driven the initial distance along the punch, the teeth of the inner ring cooperate with a contact surface of the upper die to grip the sheet material outside the cavity and restrict the lateral movement of the sheet material while the upper die moves along the punch the remaining distance.

2. The binder assembly of claim 1, wherein the upper die includes teeth on a contact surface.

3. The binder assembly of claim 2, wherein the teeth on the contact surface of the upper die are opposite the teeth on the top surface of the inner ring.

4. The binder assembly of claim 1, wherein inner and outer edges of the upper die inner walls and edges of the punch outer walls include radii.

5. The binder assembly of claim 4, wherein the inner walls of the upper die are adjacent to the outer walls of the punch when the upper die is driven downwardly along the punch the initial distance and the punch is received inside the cavity of the upper die the partial distance.

6. The binder assembly of claim 5, wherein a force of the upper die overcomes a force provided to the outer ring causing the outer ring to move relative to the punch the initial distance.

7. The binder assembly of claim 6, wherein the force of the upper die overcomes the force provided to the outer ring and a force provided to the inner ring causing the outer ring and the inner ring to move relative to the punch the remaining distance.

8. A method for stamping sheet material using a binder assembly, the method comprising:

positioning an inner ring radially between a punch and an outer ring and axially at an initial distance from an end of the punch;

positioning the sheet material on the punch and the outer ring, the sheet material extending laterally between an upper die and the punch and the outer ring;

driving the upper die along the punch the initial distance such that the sheet material moves laterally toward a cavity to facilitate shaping of the sheet material;

gripping the sheet material outside the cavity with the inner ring and the upper die once the upper die is driven the initial distance to restrict the lateral movement of the sheet material outside the cavity; and driving the upper die along the punch a remaining distance such that the sheet material inside the cavity vertically stretches to complete shaping of the sheet material, wherein, once the upper die is driven the initial distance along the punch, the teeth of the inner ring cooperate with the upper die to grip the sheet material outside the cavity and restrict the lateral movement of the sheet material while the upper die moves along the punch, the remaining distance.

9. The method of claim 8, further comprising positioning the outer ring relative to the punch so that the outer ring and the end of the punch are co-planar prior to the sheet material placement on the punch and the outer ring.

10. The method of claim 9, further comprising driving the outer ring downwardly along with the upper die the initial distance until positioned radially adjacent to the inner ring.

11. The method of claim 10, further comprising stretching the sheet material positioned between inner walls of the upper die and outer walls of the punch vertically when the upper die is driven along the punch the remaining distance.

12. The method of claim 11, further comprising driving the outer ring and the inner ring downwardly relative to the punch when the upper die is driven along the punch the remaining distance.

* * * * *